US008276904B2

(12) United States Patent
Ching-Tse

(10) Patent No.: US 8,276,904 B2
(45) Date of Patent: Oct. 2, 2012

(54) SHEET PICK-UP MODULE OF AUTOMATIC DOCUMENT FEEDER

(75) Inventor: Wang Ching-Tse, Taipei (TW)

(73) Assignee: Primax Electronics Ltd., Taipei (TW)

( * ) Notice: Subject to any disclaimer, the term of this patent is extended or adjusted under 35 U.S.C. 154(b) by 128 days.

(21) Appl. No.: 12/859,147

(22) Filed: Aug. 18, 2010

(65) Prior Publication Data

US 2011/0316218 A1 Dec. 29, 2011

(30) Foreign Application Priority Data

Jun. 25, 2010 (TW) ..... 99120852 A

(51) Int. Cl.
*B65H 5/00* (2006.01)
*B65H 3/06* (2006.01)

(52) U.S. Cl. ..... 271/10.04; 271/10.09; 271/114

(58) Field of Classification Search ..... 271/10.04, 271/10.09, 10.11, 114
See application file for complete search history.

(56) References Cited

U.S. PATENT DOCUMENTS

| | | | | |
|---|---|---|---|---|
| 5,240,239 | A * | 8/1993 | Kim | 271/10.11 |
| 6,530,706 | B2 * | 3/2003 | Sugimoto et al. | 400/625 |
| 7,441,763 | B2 * | 10/2008 | Su | 271/10.11 |
| 2005/0236759 | A1 * | 10/2005 | Acton | 271/114 |
| 2011/0316218 | A1 * | 12/2011 | Ching-Tse | 271/10.11 |

* cited by examiner

*Primary Examiner* — David H Bollinger
(74) *Attorney, Agent, or Firm* — Apex Juris, pllc; Tracy M. Heims

(57) ABSTRACT

A sheet pick-up module includes a driving shaft, a driving shaft sleeve, a pick-up driving roller, a pick-up roller sleeve and a sliding sleeve. When the driving shaft is rotated to drive rotation of the driving shaft sleeve, the driving shaft sleeve pushes the sliding sleeve toward the pick-up roller sleeve, and the sliding sleeve is rotated to push the pick-up roller sleeve, so that the pick-up driving roller and the pick-up roller sleeve are synchronously rotated to transport the document at a pick-up speed. When the feed roller is contacted with the document to transport the document at a feed speed faster than the pick-up speed, the pick-up driving roller is driven to rotate by the document, and the pick-up roller sleeve is rotate to push the sliding sleeve, so that the sliding sleeve is moved in a direction away from the pick-up roller sleeve.

6 Claims, 6 Drawing Sheets

SHEET PICK-UP MODULE OF AUTOMATIC DOCUMENT FEEDER

FIELD OF THE INVENTION

The present invention relates to an automatic document feeder, and more particularly to a sheet pick-up module of an automatic document feeder.

BACKGROUND OF THE INVENTION

In the early stage, a scanning apparatus is used to scan the image of a single document. After the document has been scanned, the document should be removed from the scanning apparatus and then a next document may be placed on the scanning apparatus in order to be further scanned. Since the process of manually replacing the document is very troublesome, the conventional scanning apparatus is not feasible to scan a stack of documents. Recently, an automatic document feeder is usually integrated into the scanning apparatus. After a stack of documents to be scanned are placed on the sheet input tray of the automatic document feeder, the automatic document feeder will successively transport the documents to perform a scanning operation without the need of manually replacing the documents. This means of automatically feeding the documents is both time-saving and efficient. The automatic document feeder is also feasible to perform a duplex scanning operation.

Generally, the automatic document feeder has a sheet input tray for placing a stack of documents. The automatic document feeder also has a sheet pick-up module for successively feeding the stack of documents from the sheet input tray to the internal portion of the automatic document feeder in a sheet-feeding direction. FIG. 1 is a schematic perspective view illustrating a sheet pick-up module of a conventional automatic document feeder. As shown in FIG. 1, the sheet pick-up module 10 comprises a driving shaft 101, a pick-up driving roller 102, a driving roller sleeve 103, a driving gear 104, a helical driving spring 105, a driven shaft 106, a pick-up driven roller 107, a driven roller sleeve 108, a driven gear 109, a transmission gear 110 and a helical driven spring 111.

The driving shaft 101 is connected to a power device (not shown) for receiving a driving force from the power device, and driven by the driving force. The driving gear 104 is fixedly disposed on the driving shaft 101, and thus the driving gear 104 is synchronously rotated with the driving shaft 101. The driving roller sleeve 103 is arranged beside the driving gear 104 and disposed on the driving shaft 101. The driving roller sleeve 103 is not always rotated with the driving shaft 101.

The helical driving spring 105 is arranged between the driving roller sleeve 103 and the driving gear 104. A first terminal 1051 of the helical driving spring 105 is sheathed by the driving roller sleeve 103. A second terminal 1052 of the helical driving spring 105 is sheathed by the driving gear 104. As such, the helical driving spring 105 is interconnected between the driving roller sleeve 103 and the driving gear 104. The pick-up driving roller 102 is disposed on the driving shaft 101. The pick-up driving roller 102 is not rotated in response to the rotation of the driving shaft 101. The pick-up driving roller 102 is arranged beside the driving roller sleeve 103, and connected to the driving roller sleeve 103. As such, the pick-up driving roller 102 and the driving roller sleeve 103 are synchronously rotated The transmission gear 110 is engaged with the driving gear 104, so that the transmission gear 110 is synchronously rotated with the driving gear 104. The driven shaft 106 is in parallel with the driving shaft 101. In addition, the driven shaft 106 penetrates through the pick-up driven roller 107, the driven roller sleeve 108 and the driven gear 109. The driven gear 109 is engaged with the transmission gear 110, so that the driven gear 109 is synchronously rotated with the transmission gear 110. The driven gear 109 is fixedly disposed on the driven shaft 106, and thus the driven gear 109 is synchronously rotated with the driven shaft 106.

The driven roller sleeve 108 is arranged beside the driven gear 109, and disposed on the driven shaft 106. The driven roller sleeve 108 is not rotated in response to the rotation of the driven shaft 106. The helical driven spring 111 is arranged between the driven roller sleeve 108 and the driven gear 109. A first terminal 1111 of the helical driven spring 111 is sheathed by the driven roller sleeve 108. A second terminal 1112 of the helical driven spring 111 is sheathed by the driven gear 109. As such, the helical driven spring 111 is interconnected between the driven roller sleeve 108 and the driven gear 109. The pick-up driven roller 107 is disposed on the driven shaft 106. The pick-up driven roller 107 is not rotated in response to the rotation of the driven shaft 106. The pick-up driven roller 107 is arranged beside the driven roller sleeve 108, and connected to the driven roller sleeve 108. As such, the pick-up driven roller 107 is synchronously rotated with the driven roller sleeve 108.

The both terminals of the helical driving spring 105 are respectively sheathed by the driving roller sleeve 103 and the driving gear 104. In addition, the helical driving spring 105 is tightened to apply tightening forces on the driving roller sleeve 103 and the driving gear 104, and thus the helical driving spring 105 is connected with the driving gear 104 and the driving roller sleeve 103. Due to the twisting direction of the helical driving spring 105, the driving shaft 101, the driving gear 104, the driving roller sleeve 103 and the pick-up driving roller 102 are only permitted to rotate in a first rotating direction C1, but fail to be rotated in a second rotating direction C2. As such, when the driving shaft 101 is rotated in response to the driving force from the power device, the driving gear 104, the driving roller sleeve 103 and the pick-up driving roller 102 are synchronously rotated with the driving shaft 101. Whereas, if the driving shaft 101 is not rotated but the pick-up driving roller 102 is rotated in the first rotating direction C1, due to the twisting direction of the helical driving spring 105, the driving roller sleeve 103 that is connected with is rotated with the pick-up driving roller 102 is rotated with the pick-up driving roller 102 in the first rotating direction C1, but the driving gear 104 that is connected with the second terminal 1052 of the helical driving spring 105 is not rotated. The operating principles of the helical driven spring 111 are similar to those of the helical driving spring 105, and are not redundantly described herein.

For feeding plural documents by the automatic document feeder, the sheet pick-up module 10 is firstly contacted with a first document (not shown) which is arranged at the uppermost position of the plural documents. Then, in response to the driving force from the power device, the driving shaft 101 is driven to rotate in the first rotating direction C1, and thus the driving gear 104 fixed on the driving shaft 101 is also rotated in the first rotating direction C1. Upon rotation of the driving gear 104, the driving roller sleeve 103 is also rotated in the first rotating direction C1, and thus the pick-up driving roller 102 is also rotated in the first rotating direction C1. On the other hand, when the driving gear 104 is rotated in the first rotating direction C1, the transmission gear 110 is rotated in the second rotating direction C2 because the driving gear 104 and the transmission gear 110 are engaged with each other. At the same time, the driven gear 109 is rotated in the first rotating direction C1 because the transmission gear 110 and the driven gear 109 are engaged with each other. Upon rotation of the driven gear 109, the driven roller sleeve 108 is also rotated in the first rotating direction C1. As such, the pick-up driven roller 107 that is connected with the driven roller sleeve 108 is also rotated in the first rotating direction C1. In this situation, the first document is fed into the internal portion of the automatic document feeder by the sheet pick-up module 10 at a sheet pick-up speed.

Generally, the automatic document feeder has a feed roller (not shown) for successively transporting plural documents at a feed speed faster than the pick-up speed. In a case that the first document is fed into the internal portion of the automatic document feeder and the front edge of the first document is contacted with the feed roller, the first document is transported by the feed roller at the pick-up speed while the rear edge of the first document is still contacted with the sheet pick-up module 10. Since the feed speed is faster than the pick-up speed, the rear edge of the first document is pulled by the front edge of the first document, and the pick-up driving roller 102 is pulled and rotated by the rear edge of the first document. In this situation, the pick-up driving roller 102 and the driving roller sleeve 103 are synchronously rotated in the first rotating direction C1. Meanwhile, the driving gear 104 is not rotated in order to avoid hindering rotation of the pick-up driving roller 102. After the first document is transported and departed from the sheet pick-up module 10, the sheet pick-up module 10 is contacted with the second document of the plural documents so as to transport the second document.

Due to the helical driving spring 105 and the helical driven spring 111 of the sheet pick-up module 10, the pick-up driving roller 102 and the pick-up driven roller 107 are only permitted to rotate in the first rotating direction C1. Since the pick-up driving roller 102 and the pick-up driven roller 107 fail to be rotated in the second rotating direction C2, the plural documents will not be moved in the direction away from the automatic document feeder. In other words, the helical driving spring 105 and the helical driven spring 111 are very important to the conventional sheet pick-up module 10. However, for overcoming the tightening forces provided by the helical driving spring 105 and the helical driven spring 111, force for driving rotation of the driving roller sleeve 103 and the pick-up driven roller 107 should be sufficiently large. In other words, the driving force provided by the power device should be sufficiently large to operate the sheet pick-up module 10. Under this circumstance, the loading of the automatic document feeder is too heavy.

SUMMARY OF THE INVENTION

The present invention provides a sheet pick-up module for reducing loading of an automatic document feeder.

In accordance with an aspect of the present invention, there is provided a sheet pick-up module of an automatic document feeder for feeding a document into the automatic document feeder. The automatic document feeder includes a feed roller. The sheet pick-up module includes a driving shaft, a driving shaft sleeve, a pick-up driving roller and a sliding sleeve. The driving shaft sleeve is fixedly disposed on the driving shaft, and synchronously rotated with the driving shaft. The pick-up driving roller is disposed on the driving shaft. The pick-up driving roller is not synchronously rotated with the driving shaft. The pick-up driving roller is contacted with the document to transport the document. The pick-up driving roller has a pick-up roller sleeve arranged beside the pick-up driving roller, and synchronously rotated with the pick-up driving roller. The sliding sleeve surrounds the pick-up driving roller. The sliding sleeve is slidable with respect to the pick-up roller sleeve, and separated from the driving shaft. When the driving shaft is rotated to drive rotation of the driving shaft sleeve, the driving shaft sleeve pushes the sliding sleeve to have the sliding sleeve move toward the pick-up roller sleeve, and the sliding sleeve is rotated to push the pick-up roller sleeve, so that the pick-up driving roller and the pick-up roller sleeve are synchronously rotated to transport the document at a pick-up speed. When the feed roller is contacted with the document to transport the document at a feed speed faster than the pick-up speed, the pick-up driving roller is driven to rotate by the document, and the pick-up roller sleeve is rotate to push the sliding sleeve, so that the sliding sleeve is moved in a direction away from the pick-up roller sleeve.

In an embodiment, the pick-up roller sleeve has a pick-up slant. A first included angle is defined between the pick-up slant and the driving shaft. The pick-up slant is extended along the driving shaft in a direction away from the pick-up driving roller, thereby defining a pick-up stopper parallel with the driving shaft. The sliding sleeve has a sliding bulge and a sliding slant. The sliding bulge is arranged at a first end of the sliding sleeve. The sliding slant is arranged at a second end of the sliding sleeve. A second included angle is defined between the sliding slant and the driving shaft. The sliding slant is extended along the driving shaft in a direction toward the pick-up driving roller, thereby defining a sliding stopper parallel with the driving shaft. The sliding slant and the pick-up slant are complementary to each other. The sliding stopper and the pick-up stopper are complementary to each other.

In an embodiment, the driving shaft sleeve has a driving slant and a driving bulge. When the driving shaft is driven to rotate and the driving shaft sleeve is synchronously rotated with the driving shaft, the driving slant pushes the sliding bulge to have the sliding bulge move toward the pick-up roller sleeve, and the driving bulge pushes the sliding bulge to have the sliding bulge rotate, so that the sliding stopper pushes the pick-up stopper to have the pick-up driving roller rotate to transport the document. When the document is transported by the feed roller at the feed speed, the document is contacted with the pick-up driving roller to drive rotation of the pick-up driving roller, the pick-up roller sleeve is synchronously rotated with the pick-up driving roller, and the pick-up slant pushes the sliding sleeve to have the sliding sleeve move in a direction away from the pick-up roller sleeve.

In an embodiment, when the document is transported by the feed roller and departed from the pick-up driving roller, the pick-up driving roller is not driven to rotate by the document, the driving slant pushes the sliding bulge to have the sliding bulge move toward the pick-up roller sleeve, and the driving bulge pushes the sliding bulge to have the sliding bulge rotate, so that the sliding stopper pushes the pick-up stopper to have the pick-up driving roller rotate to transport a next document.

In an embodiment, the driving slant and the driving bulge are integrally formed with the driving shaft sleeve.

In an embodiment, the pick-up slant and the pick-up stopper are integrally formed with the pick-up roller sleeve. The sliding bulge, the sliding slant and the sliding stopper are integrally formed with the sliding sleeve. The pick-up roller sleeve is integrally formed with the pick-up driving roller.

In an embodiment, the automatic document feeder further includes a power device, a feed shaft and a gear set. The power device is used for providing a driving force. The feed shaft penetrates through the feed roller for driving rotation of the feed roller. The gear set is connected with the power device, the driving shaft and the feed shaft for receiving the driving force from the power device, and transmitting the driving force to the driving shaft and the feed shaft.

In an embodiment, the gear set includes a double layer gear, a first transmission gear, a first transmission gear, a second transmission gear and a third transmission gear. The double layer gear is disposed on the driving shaft, and includes a first-layered gear and a second-layered gear smaller than the first-layered gear. The first-layered gear is connected to the power device for transmitting the driving force to the driving shaft. The first transmission gear is engaged with the second-layered gear for receiving and transmitting the driving force. The second transmission gear is engaged with the first transmission gear for receiving and transmitting the driving force. The third transmission gear is disposed on the feed shaft, and engaged with the second transmission gear for transmitting the driving force to the feed shaft.

In an embodiment, the power device is perpendicular to the driving shaft, and the power device is a motor.

In an embodiment, the sheet pick-up module includes a pick-up driven roller and a transmission belt. The transmission belt surrounds the pick-up driving roller and the pick-up driven roller, so that the pick-up driven roller is synchronously rotated with the pick-up driving roller.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
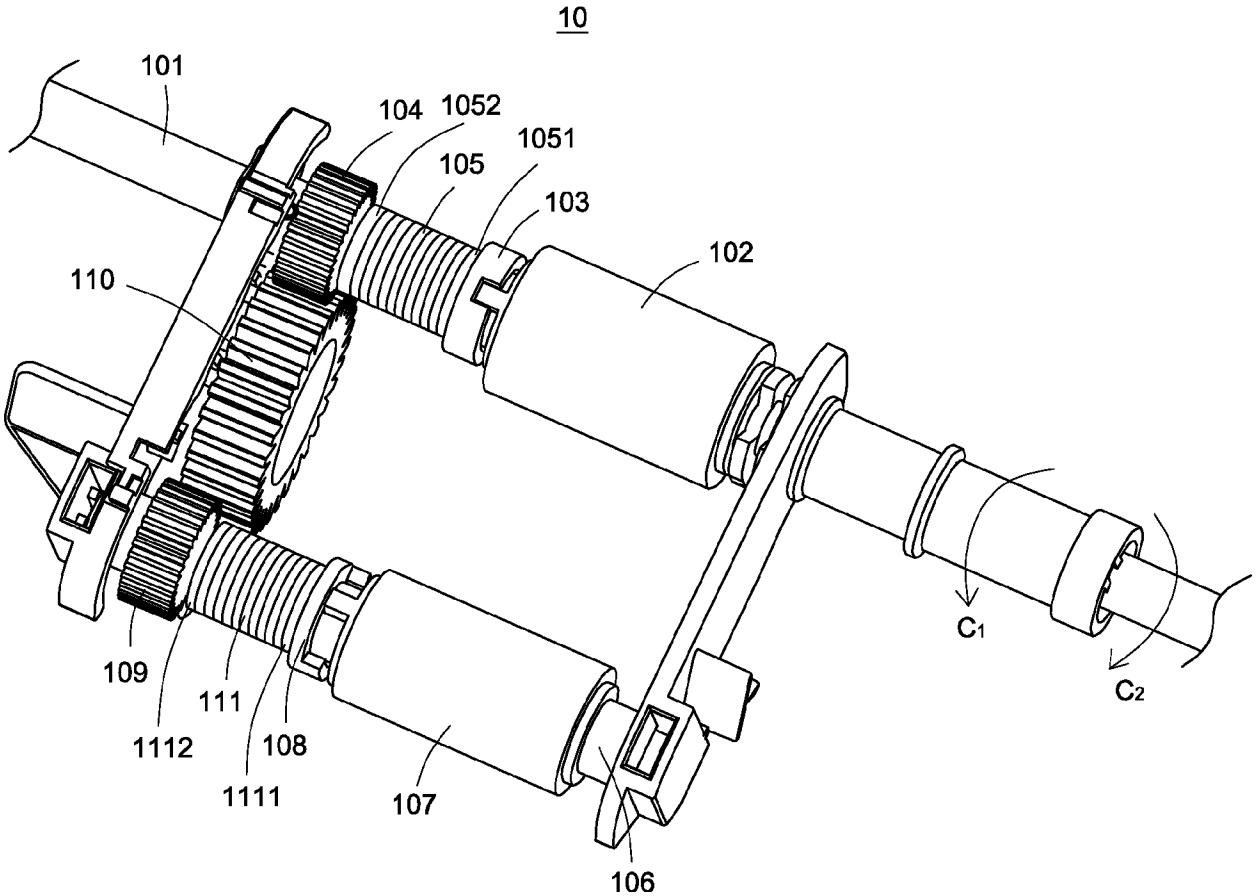
FIG. 1 (PRIOR ART)
FIG. 1 is a schematic perspective view illustrating a sheet pick-up module of a conventional automatic document feeder.
Figure 2:
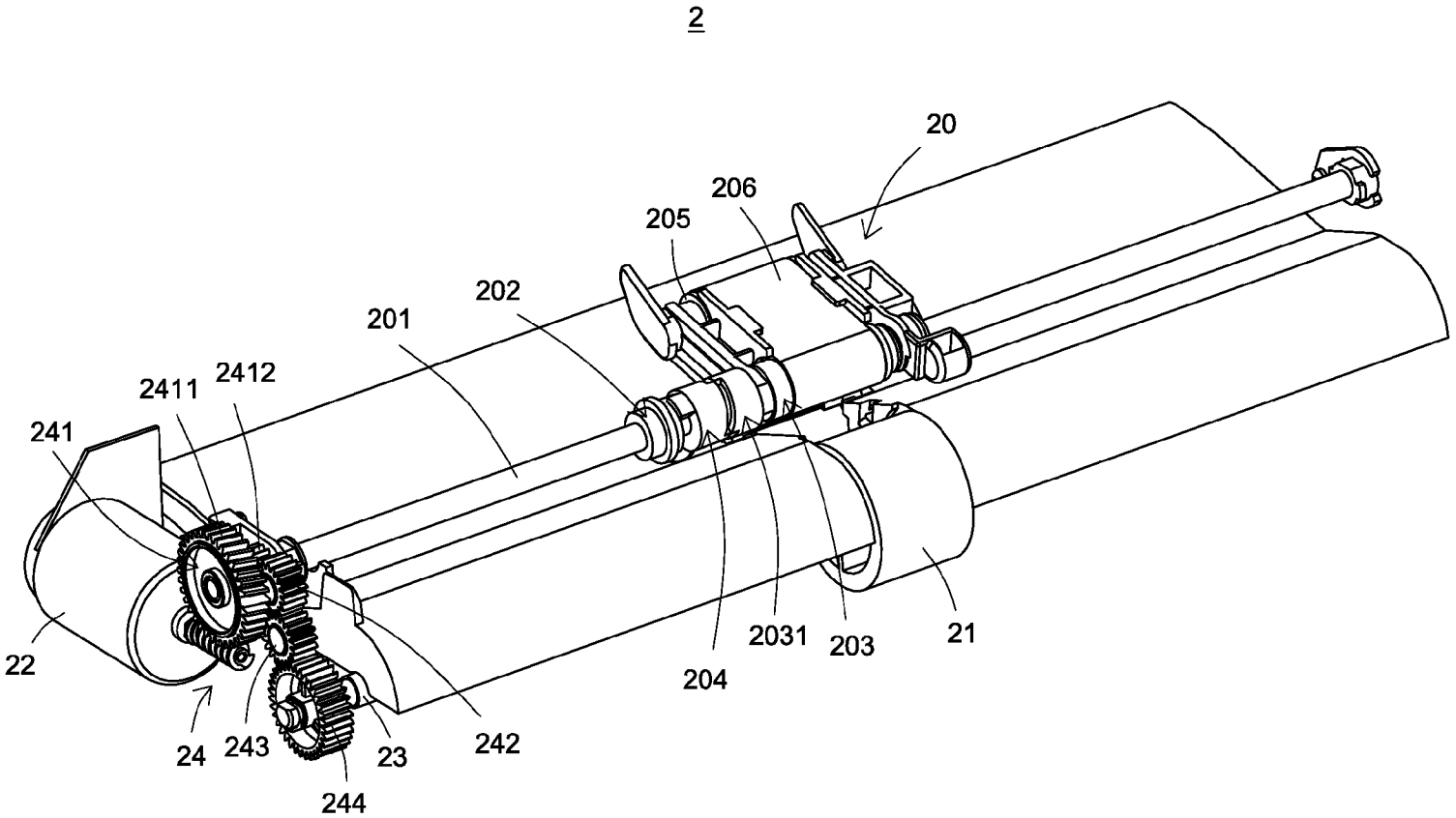
FIG. 2 is a schematic perspective view illustrating the some components of an automatic document feeder according to an embodiment of the present invention.
Figure 5:
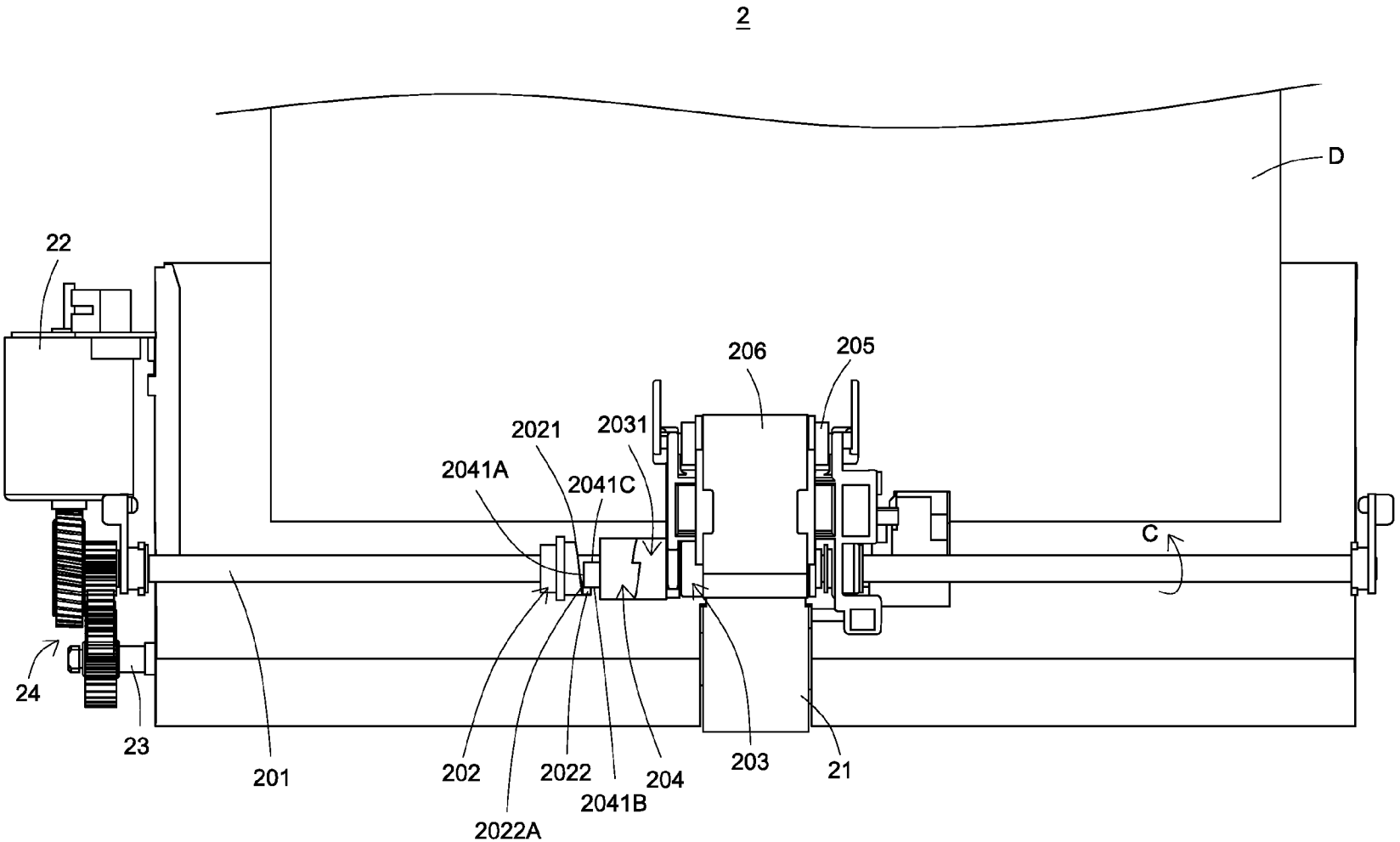
FIG. 5 is a schematic top view illustrating a sheet pick-up module of an automatic document feeder according to an embodiment of the present invention, in which the sheet pick-up module is operated in a sheet pick-up mode.
Figure 6:
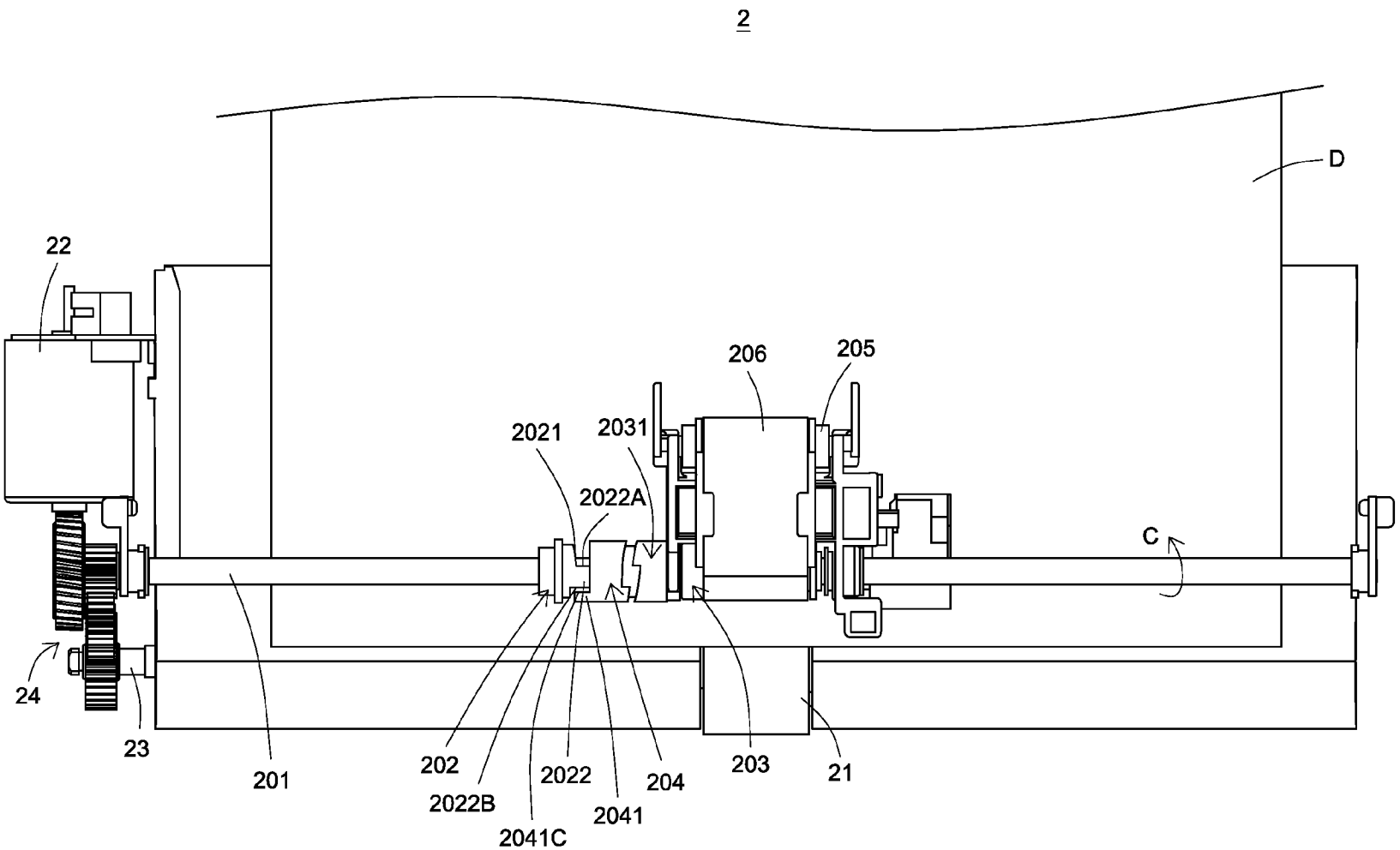
FIG. 6 is a schematic top view illustrating a sheet pick-up module of an automatic document feeder according to an embodiment of the present invention, in which the sheet pick-up module is operated in a sheet-feeding mode.

The present invention provides a sheet pick-up module of an automatic document feeder in order to obviate the drawbacks encountered from the prior art. FIG. 2 is a schematic perspective view illustrating the some components of an automatic document feeder according to an embodiment of the present invention. As shown in FIG. 2, the automatic document feeder 2 comprises a sheet pick-up module 20, a feed roller 21, a power device 22, a feed shaft 23 and a gear set 24. The feed roller 21 is used for feeding a document D (see FIG. 5 or FIG. 6) into the internal portion of the automatic document feeder 2 at a sheet feeding speed. The power device 22 is used for providing a driving force. An example of the power device 22 is a motor. The feed shaft 23 penetrates through the feed roller 21 for driving rotation of the feed roller 21. The gear set 24 is connected with the power device 22 and the feed shaft 23 for transmitting the driving force.

Figure 3:
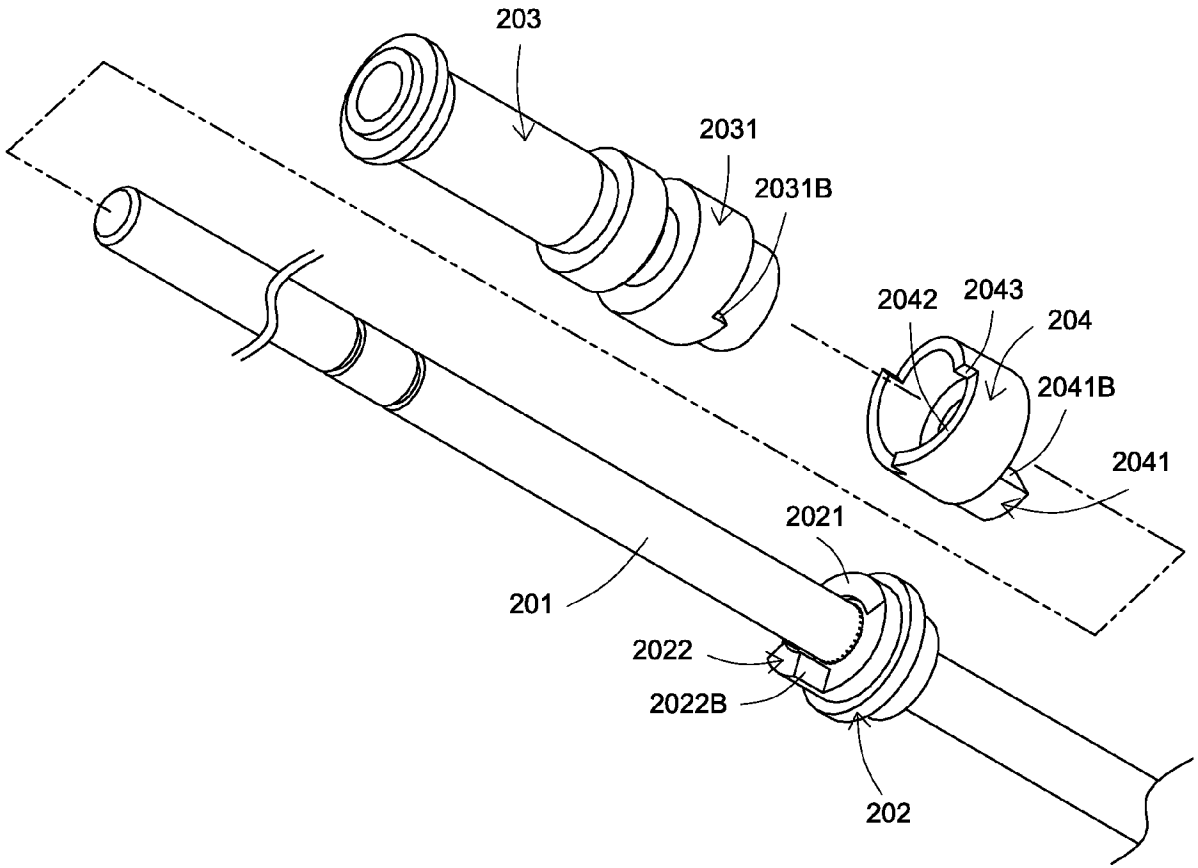
FIG. 3 is a schematic exploded view illustrating a portion of a sheet pick-up module of an automatic document feeder according to an embodiment of the present invention.
Figure 4:
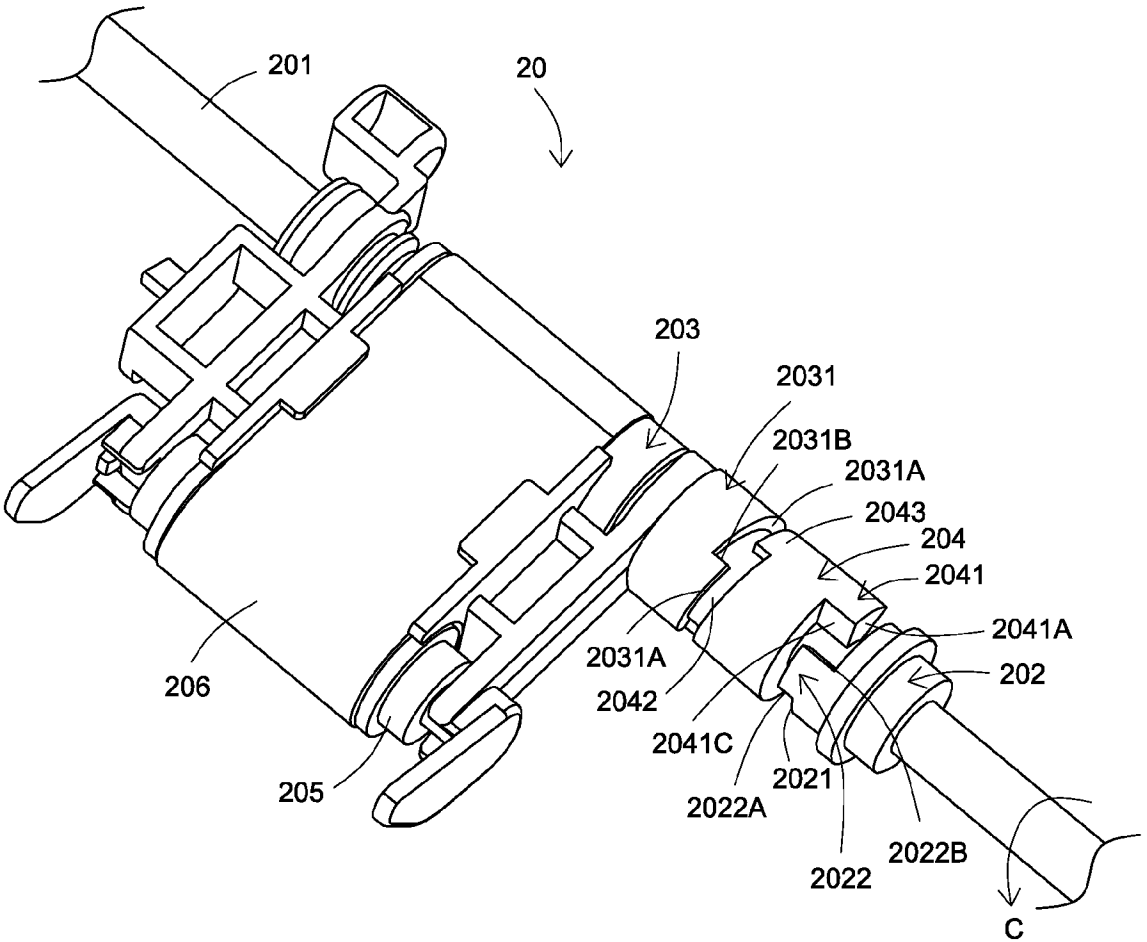
FIG. 4 is a schematic assembled view illustrating a sheet pick-up module of an automatic document feeder according to an embodiment of the present invention.

Hereinafter, the configurations of the sheet pick-up module 20 will be illustrated with reference to FIGS. 3 and 4. FIG. 3 is a schematic exploded view illustrating a portion of a sheet pick-up module of an automatic document feeder according to an embodiment of the present invention. FIG. 4 is a schematic assembled view illustrating a sheet pick-up module of an automatic document feeder according to an embodiment of the present invention. Please refer to FIGS. 3 and 4. The sheet pick-up module 20 comprises a driving shaft 201, a driving shaft sleeve 202, a pick-up driving roller 203, a sliding sleeve 204, a pick-up driven roller 205 and a transmission belt 206. The driving shaft 201 is connected with the gear set 24 for receiving the driving force from the power device 22, and driven by the driving force. The driving shaft sleeve 202 is fixedly disposed on the driving shaft 201, and synchronously rotated with the driving shaft 201. The pick-up driving roller 203 is disposed on the driving shaft 201. The pick-up driving roller 203 is not synchronously rotated with the driving shaft 201. Once the pick-up driving roller 203 is contacted with the document D, the document D is transported at a sheet pick-up speed. The pick-up driving roller 203 has a pick-up roller sleeve 2031. The pick-up roller sleeve 2031 is arranged at a first end of the pick-up driving roller 203, and synchronously rotated with the pick-up driving roller 203. In this embodiment, the pick-up roller sleeve 2031 is integrally formed with the pick-up driving roller 203. The sliding sleeve 204 surrounds the pick-up driving roller 203, and is slidable and rotatable with respect to the pick-up roller sleeve 2031. The sliding sleeve 204 is separated from the driving shaft 201. As such, the rotation of the sliding sleeve 204 is independent of the rotation of the driving shaft 201. The pick-up driven roller 205 is parallel with the pick-up driving roller 203. The pick-up driving roller 203 and the pick-up driven roller 205 are surrounded by the transmission belt 206, so that the pick-up driven roller 205 is synchronously rotated with the pick-up driving roller 203.

Please refer to FIG. 2 again. The gear set 24 comprises a double layer gear 241, a first transmission gear 242, a second transmission gear 243 and a third transmission gear 244. The double layer gear 241 is disposed on the driving shaft 201. The double layer gear 241 comprises a first-layered gear 2411 and a second-layered gear 2412. The first-layered gear 241 is connected to the power device 22 for transmitting the driving force to the driving shaft 201. The first-layered gear 2411 is larger than the second-layered gear 2412. As shown in FIG. 2, the power device 22 is perpendicular to the driving shaft 201. In such manner, the space for installing the power device 22 is reduced, and thus the overall volume of the automatic document feeder 2 is reduced. The first transmission gear 242 is engaged with the second-layered gear 2412 for receiving and transmitting the driving force from the power device 22. The second transmission gear 243 is engaged with the first transmission gear 242 for receiving and transmitting the driving force. The third transmission gear 244 is disposed on the feed shaft 23. In addition, the third transmission gear 244 is engaged with the second transmission gear 243 for transmitting the driving force to the feed shaft 23 for rotating the feed shaft 23. In response to the driving force, the driving shaft 201 and the feed shaft 23 are driven to rotate.

Please refer to FIGS. 3 and 4 again. The driving shaft sleeve 202, which is fixedly disposed on the driving shaft 201, has a driving slant 2021 and a driving bulge 2022. In addition, the pick-up roller sleeve 2031, which is arranged at the first end of the pick-up driving roller 203, has a pick-up slant 2031A. An included angle is defined between the pick-up slant 2031A and the driving shaft 201. The pick-up slant 2031A is extended along the driving shaft 201 in a direction away from the pick-up driving roller 203, thereby defining a pick-up stopper 2031B parallel with the driving shaft 201. The sliding sleeve 204 has a sliding bulge 2041 and a sliding slant 2042. The sliding bulge 2041 is arranged at a first end of the sliding sleeve 204. The sliding slant 2042 is arranged at a second end of the sliding sleeve 204. Similarly, an included angle is defined between the sliding slant 2042 and the driving shaft 201. The sliding slant 2042 is extended along the driving shaft 201 in a direction toward the pick-up driving roller 203, thereby defining a sliding stopper 2043 parallel with the driving shaft 201. The sliding slant 2042 and the pick-up slant 2031A are complementary to each other. In addition, the sliding stopper 2043 and the pick-up stopper 2031B are complementary to each other.

In this embodiment, the driving slant 2021 and the driving bulge 2022 are integrally formed with the driving shaft sleeve 202. In addition, the pick-up slant 2031A and the pick-up stopper 2031B are integrally formed with the pick-up roller sleeve 2031. In addition, the sliding bulge 2041, the sliding slant 2042 and the sliding stopper 2043 are integrally formed with the sliding sleeve 204. As shown in FIG. 3, the sliding sleeve 204 is close to the driving shaft sleeve 202. Meanwhile, the sliding slant 2042 and the sliding stopper 2043 of the sliding sleeve 204 are separated from the pick-up slant 2031A and the pick-up stopper 2031B, respectively. In addition, since the sliding sleeve 204 is stopped by the driving shaft sleeve 202, the sliding sleeve 204 is not detached from the pick-up roller sleeve 2031.

Hereinafter, the operations of the automatic document feeder 2 will be illustrated with reference to FIGS. 2 and 4. During operations of the automatic document feeder 2, the power device 22 is enabled to generate the driving force. Through the double layer gear 241, the driving force is transmitted to the driving shaft 201. As such, the driving shaft 201 is driven to rotate, but the pick-up driving roller 203 is not synchronously rotated with the driving shaft 201. When the driving shaft 201 is driven to rotate, the driving shaft sleeve 202 is synchronously rotated with the driving shaft 201, and the driving slant 2021 and the driving bulge 2022 on the driving shaft sleeve 202 are rotated with the driving shaft 201. As such, the driving slant 2021 pushes a first surface 2041A of the sliding bulge 2041 to have the sliding bulge 2041 move toward the pick-up roller sleeve 2031; and a first surface 2022A of the driving bulge 2022 pushes a second surface 2041B of the sliding bulge 2041 to have the sliding bulge 2041 rotate in a rotating direction C. In this situation, the sliding slant 2042 is contacted with the pick-up slant 2031A, and the sliding stopper 2043 pushes the pick-up stopper 2031B to have the pick-up driving roller 203 rotate. Moreover, since the pick-up driving roller 203 and the pick-up driven roller 205 are surrounded by the transmission belt 206, the pick-up driven roller 205 and the pick-up driving roller 203 are synchronously rotated to transport the document D at a feed speed (see FIG. 5).

As the pick-up driven roller 205 and the pick-up driving roller 203 are continuously rotated, the document D is transported at the pick-up speed. When the document D is transported to the position of the feed roller 21, the front edge of the document D is contacted with the feed roller 21. As such, the front edge of the document D is transported by the feed roller 21 at the feed speed, wherein the feed speed is faster than the pick-up speed. At this moment, the rear edge of the document D is still contacted with the sheet pick-up module 20, so that the document D transported at the feed speed will drive movement of the sheet pick-up module 20. In other words, the pick-up driven roller 205 and the pick-up driving roller 203 are rotated at the feed speed; but the driving shaft 201 and the driving shaft sleeve 202 are still rotated at the pick-up speed.

Since the rotating speed of the pick-up driving roller 203 is faster than the rotating speed of the driving shaft 201, the rotating speed of the sliding bulge 2041 is faster than the driving shaft sleeve 202. In this situation, the sliding bulge 2041 is separated from the first surface 2022A of the driving bulge 2022, and no longer pushed by the first surface 2022A of the driving bulge 2022. As the sliding bulge 2041 is continuously rotated, a third surface 2041C of the sliding bulge 2041 is contacted with the second surface 2022B of the driving bulge 2022. Meanwhile, the rotation of the sliding sleeve 204 is hindered by the driving bulge 2022 and the rotating speed of the sliding sleeve 204 is reduced. Then, the pick-up slant 2031A of the pick-up roller sleeve 2031 pushes the sliding slant 2042 of the sliding sleeve 204, so that the sliding sleeve 204 is moved in a direction away from the pick-up roller sleeve 2031 (see FIG. 6). In this situation, the sliding sleeve 204, the driving shaft 201 and the driving shaft sleeve 202 are running idle without hindering rotation of the pick-up driving roller 203 and the pick-up roller sleeve 2031. As such, the document D may be smoothly transported.

Then, the document D is continuously transported by the feed roller 21. After the document D is fed into the internal portion of the automatic document feeder 2 and departed from the sheet pick-up module 20, the pick-up driving roller 203 is no longer contacted with the document D, and thus the pick-up driving roller 203 is not driven to rotate by the document D. Until the pick-up driving roller 203 is contacted with a next document D' (not shown) underlying the document D, the rotation of pick-up driving roller 203 and the pick-up driven roller 205 will be stopped. Meanwhile, the rotation of the pick-up roller sleeve 2031 and the sliding sleeve 204 is also stopped. As the driving shaft sleeve 202 is continuously rotated in the rotating direction C, the driving slant 2021 pushes the first surface 2041A of the sliding bulge 2041 to have the sliding bulge 2041 move toward the pick-up roller sleeve 2031, and the first surface 2022A of the driving bulge 2022 pushes the second surface 2041B of the sliding bulge 2041 to have the sliding bulge 2041 rotate in the rotating direction C. In this situation, the sliding slant 2042 is contacted with the pick-up slant 2031A, and the sliding stopper 2043 pushes the pick-up stopper 2031B to have the pick-up driving roller 203 rotate. As such, the pick-up driven roller 205 and the pick-up driving roller 203 are synchronously rotated to transport the next document (not shown) underlying the document D at the feed speed. The principles of transporting the next document by the sheet pick-up module 20 are similar to those of transporting the document D, and are not redundantly described herein.

Generally, the automatic document feeder 2 is designed such that the feed speed of the feed roller 21 is faster than the pick-up speed of the sheet pick-up module 20. In such manner, the speed of the next document underlying the document is slower than the document in order to prevent the double feeding problem. The relation between the feeding speed and the pick-up speed may be determined according to the gear ratio of respective gears of the gear set 24 and the roller diameters of the pick-up driving roller 203 and the feed roller 21. According to the automatic document feeder 2 of the present invention, the gear ratio and the roller diameters are elaborately designed, so that the document is transported by the feed roller at the feed speed faster than the pick-up speed.

In the above embodiment, the pick-up driving roller and the pick-up driven roller of the sheet pick-up module are synchronously rotated via the transmission belt. However, those skilled in the art will readily observe that numerous modifications and alterations may be made while retaining the teachings of the invention. For example, in some embodiments, the pick-up driving roller and the pick-up driven roller are synchronously rotated via a gear set (not shown). Moreover, in the above embodiment, the sliding sleeve surrounds the pick-up roller sleeve, and the sliding sleeve is stopped by the driving shaft sleeve to avoid detachment of the sliding sleeve from the pick-up roller sleeve. In some embodiments, the sliding sleeve surrounds the pick-up roller sleeve, and the pick-up roller sleeve has a stopping structure (not shown). Due to the stopping structure, the sliding sleeve is movable with respect to the pick-up roller sleeve while avoiding detachment of the sliding sleeve from the pick-up roller sleeve.

From the above description, according to the relative motions of the driving shaft sleeve, the pick-up roller sleeve and the sliding sleeve, the sheet pick-up module of the present invention is capable of picking up a document without any other helical spring. In other words, the loading of the automatic document feeder is minimized by using the sheet pick-up module of the present invention. Moreover, in the sheet pick-up module of the present invention, since the sliding sleeve surrounds the pick-up roller sleeve and is separated from the driving shaft, the sliding sleeve is not driven by the driving shaft when the sliding sleeve runs idle. As such, the possibility of causing the erroneous operation will be minimized.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A sheet pick-up module of an automatic document feeder for feeding a document into said automatic document feeder, said automatic document feeder comprising a feed roller, said sheet pick-up module comprising:

a driving shaft;

a driving shaft sleeve fixedly disposed on said driving shaft, and synchronously rotated with said driving shaft wherein said driving shaft sleeve has a driving slant and a driving bulge, wherein when said driving shaft is driven to rotate and said driving shaft sleeve is synchronously rotated with said driving shaft, said driving slant pushes said sliding bulge to have said sliding bulge move toward said pick-up roller sleeve, and said driving bulge pushes said sliding bulge to have said sliding bulge rotate, so that said sliding stopper pushes said pick-up stopper to have said pick-up driving roller rotate to transport said document, wherein when said document is transported by said feed roller at said feed speed, said document is contacted with said pick-up driving roller to drive rotation of said pick-up driving roller, said pick-up roller sleeve is synchronously rotated with said pick-up driving roller, and said pick-up slant pushes said sliding sleeve to have said sliding sleeve move in a direction away from said pick-up roller sleeve;

a pick-up driving roller disposed on said driving shaft, wherein said pick-up driving roller is not synchronously rotated with said driving shaft, wherein said pick-up driving roller is contacted with said document to transport said document, wherein said pick-up driving roller has a pick-up roller sleeve arranged beside said pick-up driving roller, and synchronously rotated with said pick-up driving roller and wherein said pick-up roller sleeve has a pick-up slant, a first included angle is defined between said pick-up slant and said driving shaft, and said pick-up slant is extended along said driving shaft in a direction away from said pick-up driving roller, thereby defining a pick-up stopper parallel with said driving shaft, wherein said sliding sleeve has a sliding bulge and a sliding slant, said sliding bulge is arranged at a first end of said sliding sleeve, said sliding slant is arranged at a second end of said sliding sleeve, a second included angle is defined between said sliding slant and said driving shaft, and said sliding slant is extended along said driving shaft in a direction toward said pick-up driving roller, thereby defining a sliding stopper parallel with said driving shaft, wherein said sliding slant and said pick-up slant are complementary to each other, and said sliding stopper and said pick-up stopper are complementary to each other;

a sliding sleeve surrounding said pick-up driving roller, slidable with respect to said pick-up roller sleeve, and separated from said driving shaft, wherein when said driving shaft is rotated to drive rotation of said driving shaft sleeve, said driving shaft sleeve pushes said sliding sleeve to have said sliding sleeve move toward said pick-up roller sleeve, and said sliding sleeve is rotated to push said pick-up roller sleeve, so that said pick-up driving roller and said pick-up roller sleeve are synchronously rotated to transport said document at a pick-up speed, wherein when said feed roller is contacted with said document to transport said document at a feed speed faster than said pick-up speed, said pick-up driving roller is driven to rotate by said document, and said pick-up roller sleeve is rotate to push said sliding sleeve, so that said sliding sleeve is moved in a direction away from said pick-up roller sleeve;

wherein said automatic document feeder further comprises:

a power device for providing a driving force;

a feed shaft penetrating through said feed roller for driving rotation of said feed roller; and a gear set connected with said power device, said driving shaft and said feed shaft for receiving said driving force from said power device, and transmitting said driving force to said driving shaft and said feed shaft;

wherein said gear set comprises:

a double layer gear disposed on said driving shaft, and comprising a first-layered gear and a second-layered gear smaller than said first-layered gear, wherein said first-layered gear is connected to said power device for transmitting said driving force to said driving shaft;

a first transmission gear engaged with said second-layered gear for receiving and transmitting said driving force;

a second transmission gear engaged with said first transmission gear for receiving and transmitting said driving force; and a third transmission gear disposed on said feed shaft, and engaged with said second transmission gear for transmitting said driving force to said feed shaft.

2. The sheet pick-up module according to claim 1 wherein when said document is transported by said feed roller and departed from said pick-up driving roller, said pick-up driving roller is not driven to rotate by said document, said driving slant pushes said sliding bulge to have said sliding bulge move toward said pick-up roller sleeve, and said driving bulge pushes said sliding bulge to have said sliding bulge rotate, so that said sliding stopper pushes said pick-up stopper to have said pick-up driving roller rotate to transport a next document.

3. The sheet pick-up module according to claim 1 wherein said driving slant and said driving bulge are integrally formed with said driving shaft sleeve.

4. The sheet pick-up module according to claim 1 wherein said pick-up slant and said pick-up stopper are integrally formed with said pick-up roller sleeve, wherein said sliding bulge, said sliding slant and said sliding stopper are integrally formed with said sliding sleeve, wherein said pick-up roller sleeve is integrally formed with said pick-up driving roller.

5. The sheet pick-up module according to claim 1 wherein said power device is perpendicular to said driving shaft, and said power device is a motor.

6. The sheet pick-up module according to claim 1 further comprising:

a pick-up driven roller; and a transmission belt surrounding said pick-up driving roller and said pick-up driven roller, so that said pick-up driven roller is synchronously rotated with said pick-up driving roller.

* * * * *